United States Patent [19]

Portmann

[11] 4,211,070

[45] Jul. 8, 1980

[54] START-UP MOTOR ASSEMBLY FOR ROTATIONAL MACHINES

[75] Inventor: Alexandre Portmann, Nussbaumen, Switzerland

[73] Assignee: BBC Brown Boveri & Company Limited, Baden, Switzerland

[21] Appl. No.: 919,417

[22] Filed: Jun. 26, 1978

[30] Foreign Application Priority Data

Jun. 24, 1977 [CH] Switzerland ..... 7754/77

[51] Int. Cl.[2] ..... F01B 19/00; F01B 25/34

[52] U.S. Cl. ..... 60/39.08; 60/39.09 R; 60/39.14 M; 415/175

[58] Field of Search ..... 60/39.08, 39.14 M, 39.09; 415/175

[56] References Cited

U.S. PATENT DOCUMENTS

| | | | |
|---|---|---|---|
| 2,711,071 | 6/1955 | Frankel | 60/39.14 M |
| 2,751,749 | 6/1956 | Newcomb | 60/39.08 |
| 2,839,893 | 6/1958 | Rothemund | 60/39.14 M |
| 3,156,229 | 11/1964 | Manning | 60/39.14 M |
| 3,472,024 | 10/1969 | Strub et al. | 60/39.14 M |

FOREIGN PATENT DOCUMENTS

| | | |
|---|---|---|
| 1956178 | 5/1971 | Fed. Rep. of Germany . |
| 1024895 | 4/1966 | United Kingdom . |

*Primary Examiner*—Louis J. Casaregola

*Attorney, Agent, or Firm*—Burns, Doane, Swecker & Mathis

[57] ABSTRACT

The invention concerns a rotation apparatus for use with a rotating machine having a drive shaft. The rotation apparatus comprises an auxiliary shaft positioned in spaced relation relative to the drive shaft. Radial and axial bearings rotatably support the auxiliary shaft. Step-down gearing interconnects the auxiliary shaft and the drive shaft so that rotation of the former drives the latter. A rotational start-up mechanism comprising a hydrostatic motor and overriding clutch is drivingly connected to the auxiliary shaft to drive the latter. The hydrostatic motor and overriding clutch are mounted within a bearing housing of the turbine. The turbine drives a pump for supplying lubricating oil to the turbine bearings. A conduit also connects the pump with the hydrostatic motor so that the motor is continuously rotated once the turbine has been started.

3 Claims, 1 Drawing Figure

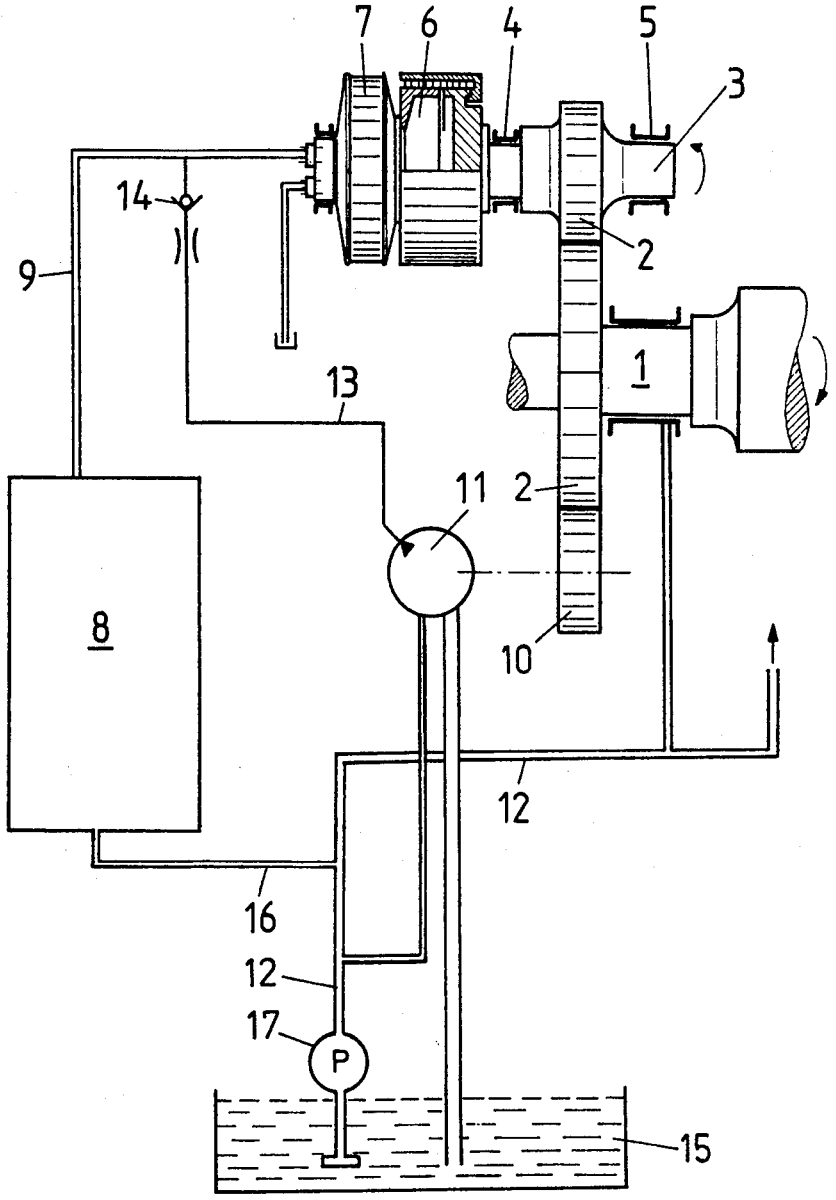
7
6
4
5
3
14
9
2
1
13
11
2
8
10
12
16
12
17
P
15

START-UP MOTOR ASSEMBLY FOR ROTATIONAL MACHINES

BACKGROUND AND OBJECTS OF THE INVENTION

The invention concerns a rotation apparatus for shafts of rotating machines, especially for turbine shafts, including a hydrostatic motor with an overriding clutch as well as an auxiliary drive mechanism for breaking the inertia as well as for turning the shaft.

When rotating machines are shut down, and especially in the case of turbines that are still heated up after operating, it is necessary to keep the shaft train rotating at a continuous rotary motion by means of a shaft-turning device in order to avoid any bending of the shaft. Furthermore, the starting of large-sized turbines poses the problem of breaking the inertia of the shaft and to set the rotor in motion without any jerking.

In the case of known turning systems the shaft trains of the turbines are usually driven by means of an electro-motor with a turbocoupling, a reduction gear and/or an overriding clutch. These known arrangements require the additional installation of an emergency shaft-turning device with a piston ratchet finger to provide for the possibility of a break-down of the drive unit, especially of the overriding clutch. This ratchet finger can be actuated either mechanically or hydraulically.

There are also known turning systems where a belt possessing a high coefficient of friction is wound around the shaft to be set in motion and is pulled by way of a linkage upon the lifting of a piston by a properly applied oil pressure in such manner that the shaft can be moved from its position of rest (see British Pat. No. 10,24,895).

However, such arrangement will solely permit the breaking of the inertia and possibly a momentary acceleration of the shaft but an extensive turning operation is not possible. Furthermore, since this rotation apparatus must make allowance for the maximum possible starting moment, the engineering expenditures will be high.

Still other shaft-turning arrangements have been in use where a hydrostatic motor is placed directly onto the turbine shaft, driving the shaft by way of a shiftable coupling or an overriding clutch, with the additional use of a pressure intensifier, designed in the form of a differential piston, to attain the high starting moment necessary to break the inertia of the shaft (see published German application 19 56 178).

It is the main disadvantage of the known arrangements that the use of electro-motors causes the rotation apparatus to start very abruptly making it necessary to employ an elastic or turbo-coupling. Furthermore, a very large step-down ratio requires the use of a multistage gearing with a disadvantageous effect on the size of the housing as well as on the overall length of the shaft train.

It is an object of the invention to provide a rotation apparatus where the turbine shaft is driven by a hydrostatic motor in such manner that an axial expansion of the turbine shaft will not influence adversely the drive motor and where the hydrostatic drive can be utilized for breaking the inertia as well as for a continuous rotation and at reduced r.p.m.

BRIEF SUMMARY OF A PREFERRED EMBODIMENT OF THE INVENTION

The invention solves at least some of these problems in that the rotation apparatus is arranged at an auxiliary shaft having one radial and one axial bearing and which connects with the turbine shaft by way of a step-down gearing.

An advantageous further feature of the invention involves arranging the auxiliary shaft with the motor and clutch within a bearing housing of the turbine.

The arrangement proposed by the invention has the primary advantage that the hydrostatic motor can be directly mounted on to an overriding clutch and that both motor and clutch components of the rotation apparatus are arranged at an intermediate or auxiliary shaft which is connected with the turbine shaft by way of a step-down gearing. The arrangement of one radial and one axial bearing at the intermediate shaft results in the additional advantage that longitudinal expansions of the turbine, taking place during operation, will have no effect on the drive unit of the rotation apparatus.

The placement of the auxiliary shaft, the rotation apparatus, and the step-down gearing within the bearing housing of the turbine offers the additional advantage that the over-all length of the shaft train can be shortened substantially. It results further in a simplified construction of the bearing housing; due to the use of a hydrostatic motor there is attained a constant turning moment which is not influenced by the r.p.m. and there is further possible an infinite variation of the shaft speed as well as a smooth starting operation so that there will be no need for an elastic coupling.

It will be particularly advantageous if the hydrostatic motor is additionally connected to the circulating oil system of the turbine so that rotation of the motor will be continuous. This produces the significant advantage that the roller bearings of the hydrostatic motor are protected because this motor can rotate at idling speed during the normal operation of the turbine.

THE DRAWING

The drawing illustrates a practical example of the rotation apparatus proposed by the invention in diagram form.

DETAILED DESCRIPTION OF A PREFERRED EMBODIMENT OF THE INVENTION

Numeral 1 denotes a shaft of a rotating machine, preferably a turbine shaft, which is in working connection with an intermediate or auxiliary shaft 3 by way of a step-down gearing 2. The intermediate shaft 3 is mounted within an axial bearing 4 and a radial bearing 5. At the auxiliary shaft 3 there is further arranged an overriding clutch 6, preferably a loop-spring overriding clutch, with hydrostatic motor 7 which make up the drive unit for the rotation apparatus. The hydrostatic motor 7 is supplied with full oil pressure by way of a conventional control unit 8 and a pipe line 9. The control 8 may comprise a valve which is actuated to close the conduit 9 once the turbine has been started. The working pressure which is needed for the movement to break the inertia and for the turning of the turbine shaft at normal speed is delivered from the conduit 9. At the main gear of the step-down gearing 2 at the turbine shaft 1 there is provided an additional drive wheel 10 to drive a main oil pump 11 for the oil supply for the bearings. The main oil pump 11 provides the turbine with lubricants by way of a pressure-oil line 12, while at the same time supplying the hydrostatic motor 7 by way of a branch pipe line 13 and a one-way valve 14 with a mixed-oil pressure for a no-load speed. The main oil pump 11 and a separate driven auxiliary oil pump 17 for the start-up lubrication of the bearings at the turbine start both draw lubricants from an oil tank 15, the latter supplying the lubricating points of the turbine as well as the control unit 8, by way of oil line 16.

The motor 7, clutch 6 and shaft 3 are located within the bearing housing 1A of the turbine.

The arrangement proposed by the invention operates as follows:

When the turbine is at standstill and if it is desired to break the inertia of the turbine shaft 1, the auxiliary oil pump 17 is activated which provides pressurized oil to the various bearings of the turbine via conduit 12. At the same time there is flowing by way of oil line 16 hydraulic oil into the control unit 8 from where it reaches by way of pipe line 9 the hydrostatic motor 7 which now begins to rotate. This rotating motion is transmitted by way of the overriding clutch 6 to the auxiliary shaft 3, and from there to the step-down gearing 2 and to the turbine shaft 1, starting up the rotor of the turbine. As soon as the turbine has reached the starting speed, the control unit 8 cuts off the flow of hydraulic oil through the pipe line 9. At the same time, oil at reduced pressure is now being supplied to the hydrostatic motor 7 by the main oil pump 11 (driven by the turbine) through the branch pipe line 13 so that the motor will turn at no-load speed, preferably at approximately 1 revolution/min. This insures a continuous, slow rotation of the hydrostatic motor 7 to protect the roller bearings against operating vibrations.

When the turbine is shut down and the r.p.m. of the turbine shaft 1 has dropped to a predetermined value, the hydrostatic motor 7 is returned to its rated speed by the control unit 8 so that at a further drop in turbine speed the turbine shaft 1 will be kept rotating.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. Turbine rotating apparatus for use with a turbine of the type including a drive shaft mounted for rotation in bearings, and an auxiliary shaft arranged in spaced parallel relationship with said turbine drive shaft, said turbine drive shaft connected to said auxiliary shaft by means of step down gear means, the turbine rotating apparatus comprising:

drive means including a hydrostatic motor and clutch means mounted on said auxiliary shaft, first conduit and pump means for supplying oil to said hydrostatic motor, and second conduit and pump means to deliver oil from an oil supply to the bearings of the drive shaft, said second conduit means connecting said second pump means to said hydrostatic motor for supplying oil to continuously rotate said motor at reduced speed after the turbine has been started.

2. Apparatus according to claim 1, wherein said clutch means comprises an overriding clutch.

3. Apparatus according to claim 1, wherein said second pump means is connected to said turbine to be driven by the turbine once the latter has been started.

* * * * *